US006076547A

United States Patent [19]

Steinhardt et al.

[11] Patent Number: 6,076,547

[45] Date of Patent: Jun. 20, 2000

[54] DEVICE FOR OPERATING A MECHANISM OF A RINSING FIXTURE

[76] Inventors: Lothar Steinhardt, Kehlweg 19, D-65239 Hochheim; Jörg-Michael Steinhardt, Hellebergstrasse 15a, D-65232 Taunusstein, both of Germany

[21] Appl. No.: 09/134,844

[22] Filed: Aug. 14, 1998

[30] Foreign Application Priority Data

Aug. 15, 1997 [DE] Germany ..... 197 35 592

[51] Int. Cl.[7] ..... F16K 31/30; F16K 33/00

[52] U.S. Cl. ..... 137/413; 137/422; 137/411; 137/421; 137/423; 251/57

[58] Field of Search ..... 251/57; 137/423, 137/412, 413, 422, 386, 448, 411, 421

[56] References Cited

U.S. PATENT DOCUMENTS

| | | | |
|---|---|---|---|
| 1,707,926 | 4/1929 | Reeder | 251/57 |
| 1,759,663 | 5/1930 | Peter | 251/57 |
| 1,764,825 | 6/1930 | Browne | 251/57 |
| 2,790,459 | 4/1957 | Thomas | 137/412 |
| 3,860,028 | 1/1975 | Moore | 137/411 |
| 5,249,745 | 10/1993 | Bertolotti | 239/76 |

*Primary Examiner*—Denise L. Ferensic
*Assistant Examiner*—Ken Rinehart
*Attorney, Agent, or Firm*—Max Fogiel

[57] ABSTRACT

The invention concerns a device for operating a mechanism (5) of a rinsing fixture, in particular for operating a closing and opening mechanism or a locking mechanism of a rinsing fixture. It shows a float (28) and a first hydraulic or pneumatic force means (15) that shows a regulating unit (16) that is controllable through a float. A second hydraulic or pneumatic force means (9), which has a regulating unit (8) that is connected hydraulically or pneumatically with the regulating unit of the first force means, has an active connection with the mechanism (5).

According to the invention it is planned that upon rising the float, in opposition to a restoring force, drives the regulating unit of the first force means for operating the mechanism, that the float upon sinking is uncoupled from the regulating unit of the first force means, and that a valve (12) is arranged in the connection (11, 13) of the two force means. The valve is controlled by the float for movement of the regulating unit of the first force moans or by an additional float, so that the connection is open upon the rising of the float, is closed off when the float has risen or is sinking and is open when the float has sunk.

11 Claims, 9 Drawing Sheets

1
2
3
4
5
6
7
8
9
10
11
12
13
14
15
16
17
18
19
20
21
22
23
24
25
26
27
28
29
37

28
25
37
15
29
12
9
3
6
5
1

28
25
15
36
29
13
12
11
9
5
1
3
6
20
21
30
31

DEVICE FOR OPERATING A MECHANISM OF A RINSING FIXTURE

BACKGROUND OF THE INVENTION

The invention relates to a device for operating a mechanism of a rinsing fixture. It concerns, in particular, a device for operation of a closing and opening mechanism or of a locking mechanism of a rinsing fixture. The device comprises a float and a first hydraulic of pneumatic force means that shows a regulating unit controllable by means of the float as well as a second hydraulic or pneumatic force means that shows a hydraulic or pneumatic regulating unit that is connected with the regulating unit of the first force means, whereby this regulating unit is actively coupled to the mechanism. The float is attached, for example, to a rod. The regulating unit of the first force means is able to be driven by this float rod.

A device for operating the closing and opening mechanism of the type named in the introduction is known from DE 37 18 812 A1. The mechanism serves to operate a float-controlled cut-off valve of a rinsing chamber for rinsing a storage space for a liquid, whereby the float is effective in the region of the low point of the bottom of the storage space. Upon the emptying of the storage space, with the sinking motion of the float the float rod connected to the float operates the mechanism of the cut-off valve, the float rod being fixedly connected with the regulating unit related to the valve, whereby the regulating unit is operated by the lifting as well as by the sinking of the float. Due to this connection of the float rod with the regulating unit of the first hydraulic force means and the hydraulic connection of this regulating unit with the regulating unit of the second force means at the rinsing fixture, a displacement of the one regulating unit causes a displacement of the other regulating unit. In order to achieve a sudden opening of the mechanism in the manner of an instantaneous opening, in the known device the float is attached in a pivoted manner to the float rod and, referring to the raised position of the float rod with weight, the float rod, on the basis of a tipping lever located on it that grasps a stationary support, is prevented from sinking as soon as the storage space runs empty. The pivoted float, on the contrary, can follow the lowering liquid level and by way of a control rod on the tipping lever influences the tipping lever in such a way that it is released from the support upon the emptying of the storage space, whereupon the float rod with the weight swings instantaneously downward and drives the hydraulic force means. Hydraulic fluid passes into the enlarging space of the first hydraulic system that is designed as a bellows, whereby the space of the second hydraulic system that is also designed as a bellows enlarges and its regulating unit opens the mechanism of the cut-off valve.

Disadvantages of this device are the high construction cost in the area of the float and the high cost of the control. In particular, the pivoting of the float must be assured over a long time period, since the device otherwise cannot function. Here one must take into consideration that the device is exposed to mixed liquids or waste water, which contains considerable amounts of contaminants and from this the danger exists that the float mounting can become blocked. With this device the releasing of the rinsing can be only poorly adjusted.

The fundamental problematic nature of the cleaning of the bottom of a storage space by means of liquid accumulated in a rinsing chamber is described in EP 0 211 058 A1.

From EP 0 658 657 A2 is known a device for operating a locking mechanism of a tilt-rinsing fixture for rinsing a length of channel. The liquid level of the channel at any given time is determined by an inductive sensor and is passed on by an evaluation unit, which then, when it ascertains a complete emptying of the channel or channel shaft, sends forward a releasing impulse to the locking mechanism that holds fast the tilt-rinsing equipment that is filled with rinsing liquid.

A further fundamental possibility for rinsing of a storage space is described in DE 195 33 483 A1. This shows a locking mechanism for a rinsing fixture that is fully or partially raisable from the bottom and is designed as a rinsing container.

SUMMARY OF THE INVENTION

The task of the present invention is to advance the design of a device according to the type mentioned in the introduction for operating a mechanism of a rinsing fixture, in particular for operation of a closing and opening mechanism or of a locking mechanism of a rinsing fixture, so that a rapid float-controlled activation of the mechanism of a rinsing fixture for instantaneous rinsing is assured and that this is done in a simple manner as well as with little production expense.

The task is solved in a device of the type named in the introduction in this way, that the float upon rising drives, against a restoring force, the regulating unit of the first force means for operating the mechanism, that the float upon sinking is uncoupled from the regulating unit of the first force means, and that in the connection of the two force means a valve is arranged that is controlled by the float for moving the regulating unit of the first force means or is controlled by another float, in such a manner that the connection is opened by the lifting of the float, that it is closed off by the raised float as well as during the sinking of the float and that it is opened by the sunken float.

It is essential to the present invention that the float is coupled to the regulating unit of the first force only when raised. With the raising of the float the regulating unit of the first force means moves together with the float and, due to the connection with the regulating unit of the second force means, causes the latter regulating unit to likewise be moved and thus, for example, operate the closing mechanism in the sense of a closing movement or transfer the locking mechanism into its locking position. Since with the sinking the float is uncoupled from the regulating unit of the first force means, the float itself cannot transfer the closing mechanism into its open position or the locking mechanism into its released position. To be sure, the restoring force works, now as before, on the regulating unit of the first force means. If the float sinks due to the decoupling of the float and the regulating unit of the first force means, with the maintaining of the position of the regulating unit of the first force means the sunken float operates the valve arranged in the hydraulic connection of both force means, which valve is instantaneously opened. In place of this float the operation of the valve can take place through another float. This auxiliary float has the sole task of operating the fast-opening valve, while the other float serves the driving of the first force means. Preferably it is a question of a single-float control, i.e., only one float is planned and that the task is to drive a first force means or a series of first force means and to operate the valve.

According to the invention, with the valve opened both regulating units under the influence of the restoring force can be effective in the opposite direction, with the result that the regulating unit of the second force means operates the mechanism. for example opens or closes the mechanism and thus releases the rinse or closes it off or moves a locking mechanism out of or into its locking position and thus releases or engages a locking position. With a renewed accumulation of liquid and thus with the raising of the float(s) the regulating unit of the second force means is moved by means of the regulating unit of the first force means and the valve is closed.

Advantageously the float that drives the first force means is connected with a float rod that is mounted so that it can pivot and can be brought into an active connection with the first force means.

A particular configuration of the invention provides for the restoring force to be generated by means of a spring or a bellows, in particular a spring-loaded bellows that drives the regulating unit of a force means, in particular of the first force means. Further, another spring or another bellows, especially another spring-loaded bellows, can drive the regulating unit of the other, in particular a second, force means. The effective directions of the springs or bellows, in particular spring-loaded bellows, are opposed and the spring or bellows of the other, in particular of the second, force means, is weaker than the spring or the bellows of the one force means, in particular the first force means. Here the weaker spring or the weaker bellows serves the purpose of supporting the closing or locking process since with the raising of the float hydraulic fluid is forced out of the second hydraulic force means and in this way supports the closing process of the closing mechanism or the locking process of the locking mechanism. The changing of the effective direction in the system can be achieved simply by exchanging the different strength springs.

From a construction viewpoint the device can be simply designed if the first and also the second force means show a cylinder that includes a regulating unit configured as a bellows or as a spring-loaded bellows The float rod or the closing/opening mechanism or the locking mechanism grasps a rod connected to the piston.

According to a particular implementation form of the invention provision is made for the valve to be configured as a check valve that its basic closing direction can be unblocked by means of the float or the other float, in particular the float rod provided with the float or the other float. The check valve is thus always passable in one direction of liquid flow, whereas it prevents liquid flow in the opposite direction, as long as it is not unblocked by the float rod. One such check valve requires only a minimal construction cost and a simple addition to the hydraulics is possible without distribution pieces. With this a separate bypass required to detour around the check valve becomes unnecessary. The check valve designed according to the invention thus represents a cost-effective configuration. The few pipe connections reduce the danger of leakage. With defective hydraulic function only the replacement of one part is required; this considerably simplifies the search for the defect. Only a slight raising is required to accommodate large changes of cross-section of the valve. Due to this minimal raising this valve can be hermetically sealed and is thus especially well suited for installation in a rough environment, for example in connection with waste water A design for the check valve that is particularly simple to build provides for a slidable plunger in the valve housing for raising a shut-off element from its valve seat, which element closes off passage through the valve. The plunger is here slidable against the force of a restoring force element. The displacement is accomplished preferably through the float rod. The shut-off element is preferably designed as a ball and the restoring force element is designed as a spring, in particular as a coil pressure spring.

The hermetically sealable design of the check valve can be achieved in an especially simple manner by having the plunger work in combination with an elastic membrane that is connected with the valve housing so that it is sealed. For example, the float rod pushes against the membrane, that is preferably designed as a steel membrane, and displaces this along with the plunger and thus closes off the check valve.

Besides the design of the previously described conceptual check valve, the various designs of a valve for achieving the objectives according to the invention come into question. The valve can, for example, be designed as a check valve, where a bypass is operated by means of a float, so that the hydraulic oil can flow past the check valve against the passage direction of the check valve Further, the valve can, for example, be configured as a ball valve whereby the ball valve, corresponding to the position of the float or of the other float, assumes the desired passage or cut-off position.

The invention is not limited to having a float rod pivotable around one axis that consequently works as a single-armed or a two-armed lever that accepts the float in the region of the far end, it is just as possible to mount the float to be vertically or horizontally displaceable and to provide for such a coupling with the regulating unit of the first force means that the float, when rising, carries the regulating unit along and that the float can sink down without the driving of this regulating unit.

In principle the possibility exists of operating, by means of a float rod or something similar and a first force leans coordinated with this, several second force means and thus mechanisms of several rinsing fixtures, or of locking several rinsing fixtures. For this, between the valve and the mechanisms for opening, closing, locking or releasing, provision is made for a distribution of the connecting pipes into several branching connections corresponding to the number of mechanisms.

On the other hand the possibility exists of providing for several first force means and several second force means that are controlled by separate valves and one common float rod or the like. With this design the possibility exists of a time-delayed opening of the valve for example by means of the float rod, i.e., the float rod opens the one valve earlier than another one in correspondence with the liquid level in the storage space. The adjustment can be accomplished through positioning screws or through the valves being at different levels.

Several rinsing courses can thus be operated in a time-delay fashion, whereby the possibility exists of allowing rinsing processes to run in sequence, being controlled by only one float.

Further characteristics of the invention are represented in the dependent claims, in the description of the figures and in the figures themselves, where it should be noticed that all individual characteristics and all combinations of individual characteristics are essential to the invention.

BRIEF DESCRIPTION OF THE DRAWINGS

In the figures the invention is represented by way of example with the help of several implementation forms, without being limited to these. Shown in greatly simplified representation are:

(FIG. 1A: closing mechanism in the opened position; FIG. 1B: closing mechanism closing; FIG. 1C: closing mechanism in locking position).

(FIG. 2A: closing mechanism in locking position; FIG. 2B: closing mechanism opening; FIG. 2C: closing mechanism opened).

DESCRIPTION OF THE PREFERRED EMBODIMENTS

Figures 1A, 1B, 1C:
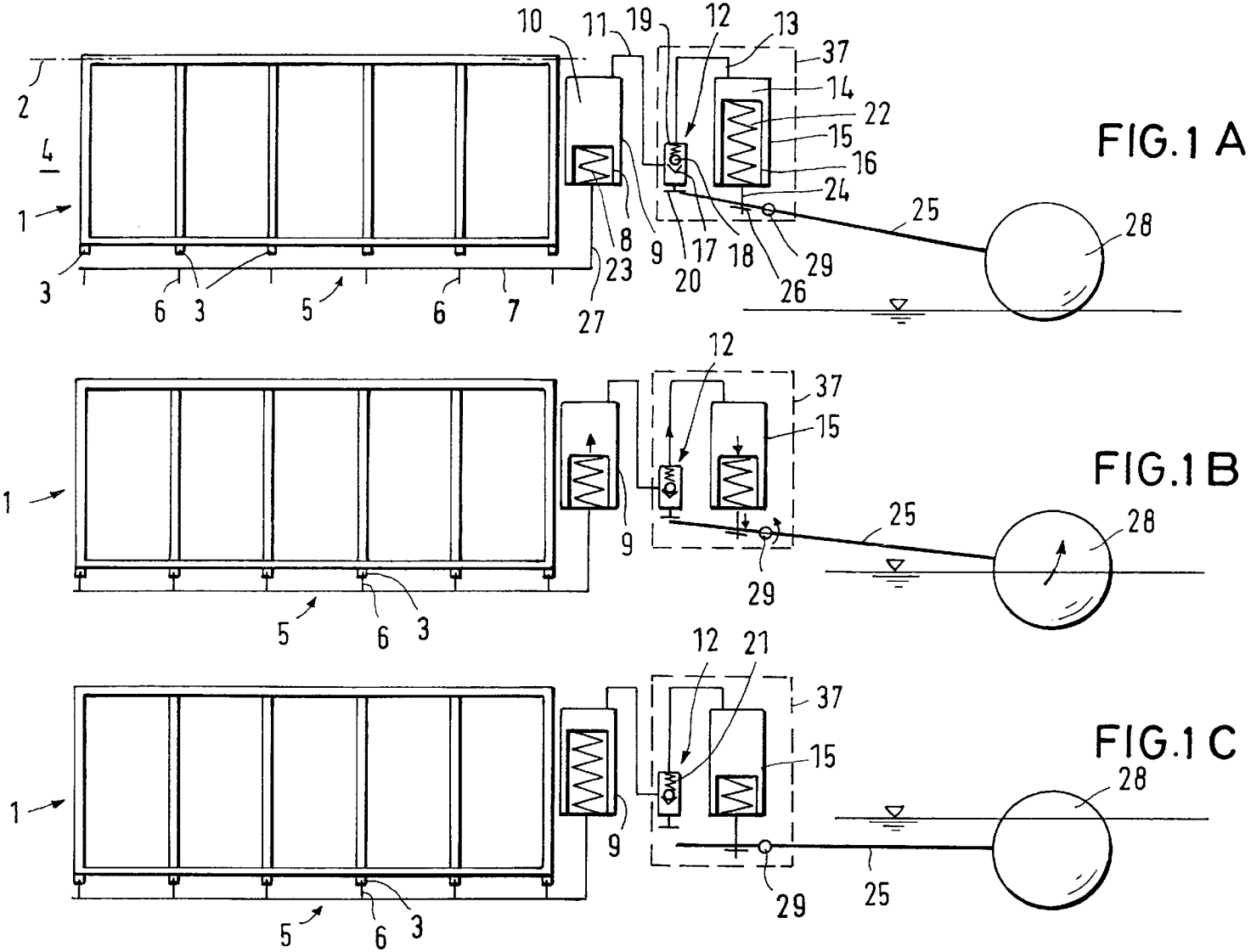
FIGS. 1A, 1B, and 1C a first implementation form of a device for operating a closing mechanism of a cut-off flap shown in the closed position with the flap locked

FIG. 1A shows a rectangular cut-off flap 1 that serves the closing off of a corresponding rectangular inlet opening of a rinsing chamber. The cut-off flap 1 is attached to an outer wall of the rinsing chamber so as to be pivotable around an upper horizontal axis 2. A storage space is connected to the rinsing chamber, so that after the emptying of the storage space the latter can be rinsed out by means of the liquid accumulated in the rinsing chamber, if the cut-off flap 1 is opened. In the region of its lower end the cut-off flap 1 is provided with lugs 3 that project beyond it downward, which can be brought into working connection with a closing mechanism 5 that is likewise connected to the outlet wall 4. The closing mechanism 5 can for example show a pivotable shaft 7 with lugs 6, which lugs, when the cut-off flap 1 is in the closed position, i.e., when the flap 1 is in the vertical position, are tilted so that they engage the lugs 3 from behind and thus press the cut-off flap 1 against the wall 4 or against its frame and prevent a swinging away of the cut-off flap 1 from the rinsing chamber opening. The closing mechanism 5 can, for example, also be designed as a pusher construction, as is described, for example, in DE 37 18 812 A1. The closing mechanism 5 is moved, i.e., the shaft 7 is rotated or a bolt is pushed, by means of a bellows 8 that is carried in a cylinder 9. A pipe 11 is connected to the internal space 10 of the cylinder 9, which pipe leads to a check valve 12 and from this another pipe 13 leads to the inner space 14 of another cylinder 15 into which a bellows 16 leads. The basically free passage direction of the check valve 12 is from the pipe 11 arranged with the cylinder 9 into the pipe 13 arranged with cylinder 15. Shown is the valve seat 17 for check valve 12 and the ball 18 that works in conjunction with this. Located in the housing 19 of the check valve 12 is plunger 20 that is mounted in such a way that it can be pushed and that, in the position of having been driven into the housing 19, lifts the ball 18 from the valve seat 17 and thus enables passage in both directions through the valve 12. The ball 18 is spring loaded by means of a spring 21 in the direction of the valve seat 17.

Effective in bellows 16 is a relatively strong pressure spring 22 that spring loads the bellows 16 in the direction of the pipe 13. Corresponding to this, arranged in bellows 8 is a relatively weak pressure spring 23 that spring loads the bellows 8 in the direction of pipe 11.

Leading out of the cylinder 15 and connected with bellows 16 is a rod 24 that leads through an opening, not shown in detail, in a float rod 25 formed as a lever. The rod 24 is provided with a pivotable drive plate 26 on the side that is turned away from the cylinder 15, which plate engages the float rod 25 from behind. Corresponding to this is a rod 27 connected with the bellows 8 of cylinder 9, which rod 27 leads out of the cylinder housing 10 and drives the movable component that effects the closing process, either directly by a translational motion or through conversion of the translational motion to rotary motion.

The float rod 25 in the region of one end carries a ball-shaped or cylinder-shaped float 28 and can be pivoted around an axis 29. In the lowest position of the float the lever arm of the float rod 25 opposite the float 28 contacts the plunger 20 of the check valve 12, so that the ball 18 is raised from the valve seat 17. This condition is illustrated in FIG. 1A and shows clearly the flap 1 with the lugs 6 of the closing mechanism 5 that release the lugs 3.

A mounting plate shown in dashed lines is indicated by the reference numeral 37. The plate provides the stationary mounting for the bearing axis 29, the float rod 25, the cylinder 15 and the check valve 12.

Proceeding from the position according to FIG. 1A, with the complete sinking of the float 28, relatively relaxed pressure spring 22 and relatively stressed pressure spring 23 as well as driven plunger 20 of check valve 12 the float rises upon accumulation of a liquid in the storage space (not illustrated further). In consequence of the pivoting motion of the float rod 25 resulting from this, the latter comes out of contact with the plunger 20 of the check valve 12, whereupon the valve 12 works exclusively as a check valve. Furthermore, the float rod 25, by way of the drive plate 26, pulls the rod 24 along with the bellows 16 downward against the force of the strong pressure spring 22 into the cylinder 15 so that due to the adjusting increased cylinder volume, hydraulic fluid flows out of the cylinder 10 through the pipes 11 and 13 into cylinder 15, The relatively weak pressure spring 23 that is effective on bellows 8 supports its displacement and thus the transfer of hydraulic fluid from cylinder 9 into cylinder 15, whereby the rod 27 shifting along with the bellows 8 operates the closing mechanism 5. FIG. 1B illustrates the process of the closing mechanism. Upon further inflow of liquid into the storage space the float is raised higher and float rod 25 pivots further. The float rod 25 remains out of contact with the plunger 20 of the check valve 12 while the pressure spring 22 located in the cylinder 15 is further stressed through float rod 25 and the pressure spring located in cylinder 8 is further relaxed FIG. 1C shows the condition where the closing mechanism 5 has been transferred into its locking position in which the lugs 6 of the closing mechanism 5 engage the lugs 3 of the cut-off flap 1 in such a way that the cut-off flap 1 is completely pressed against the outlet wall 4 of the rinsing chamber or against its frame.

Figures 2A, 2B, 2C:
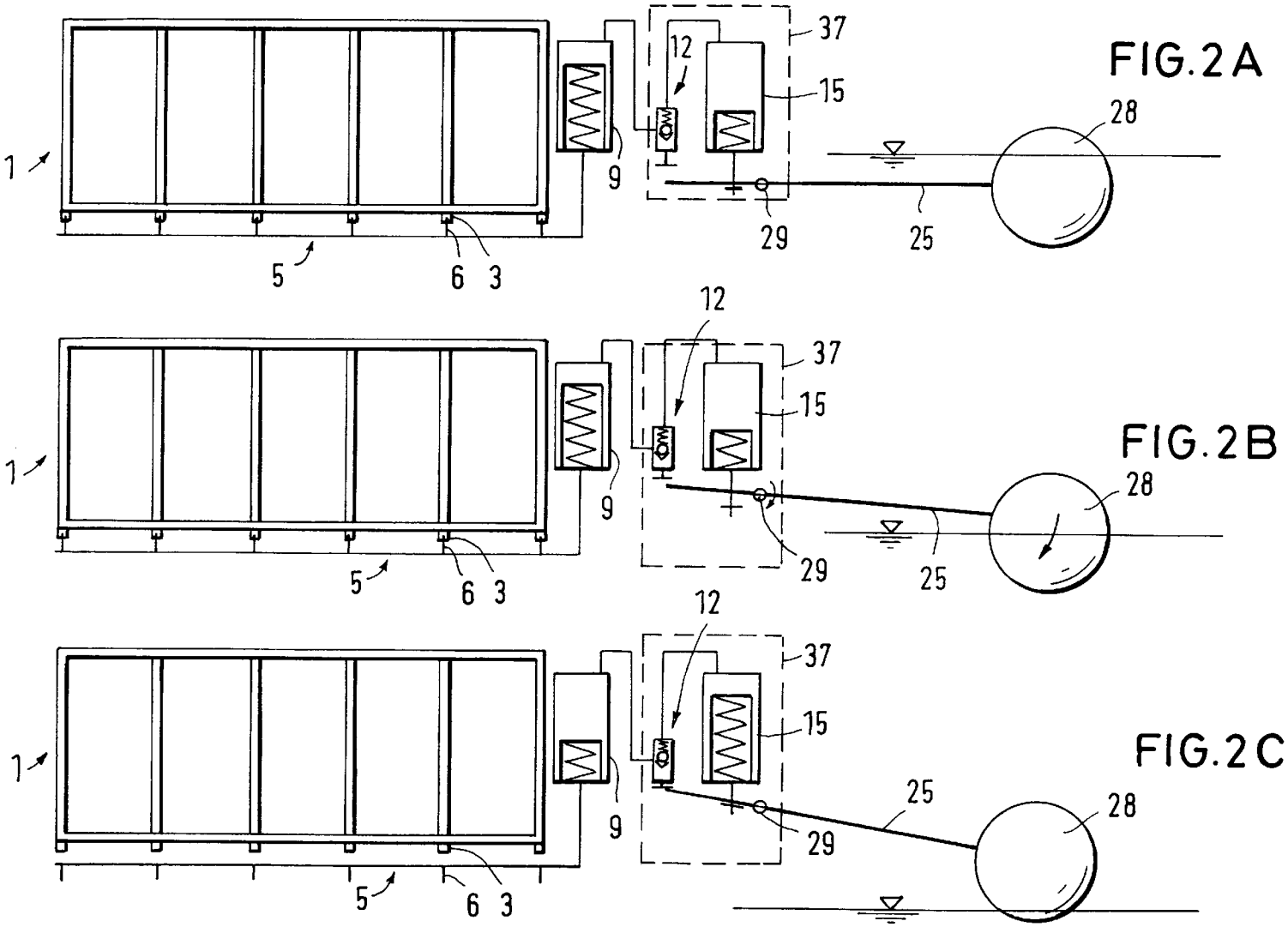
FIGS. 2A, 2B, and 2C the implementation form of the device according to FIGS. 1A through 1C with unlocking of the flap

The FIGS. 2A through 2C show the steps in the opening of closing mechanism 5. The condition of the closing mechanism 5 according to the representation in FIG. 2A corresponds to that of the representation in 1C. If The liquid level in the storage space and thus the float 28 sinks, the float rod 25 pivots back, whereby due to the closed position of the check valve 12 the spring-loaded bellows 8 and 16 of cylinders 9 and 15 remain in their positions, while the float rod 25 moves relative to the rod 24 that passes through it. FIG. 2B shows the partially sunken float 28 and the condition of the cut-off flap 1 shortly before its opening.

If the float 28 sinks lower, to a level that corresponds to the emptied condition or the near-emptied condition of the storage space, the float rod 25 has reached an angle at which it contacts the plunger 20 of the check valve 12 and thus lifts the ball 18 of the check valve 12 from its seat 17. With this, due to the effect of the bellows 16 that is stressed by a strong spring 22, the hydraulic fluid can enter through the pipes 11 and 13 into the inner space 10 of cylinder 9 and it presses the bellows 8 located there against the force of the weaker spring 23 acting on it. In consequence of this motion of bellows 8 and thus of the motion of its rod 27 the closing mechanism is driven so that its lugs 6 release the lugs 3 of the cut-off flap 1, whereby this flap opens instantaneously under the pressure of the liquid located in the rinsing chamber. The opened closing mechanism 5 is illustrated in FIG. 2C.

Figure 3:
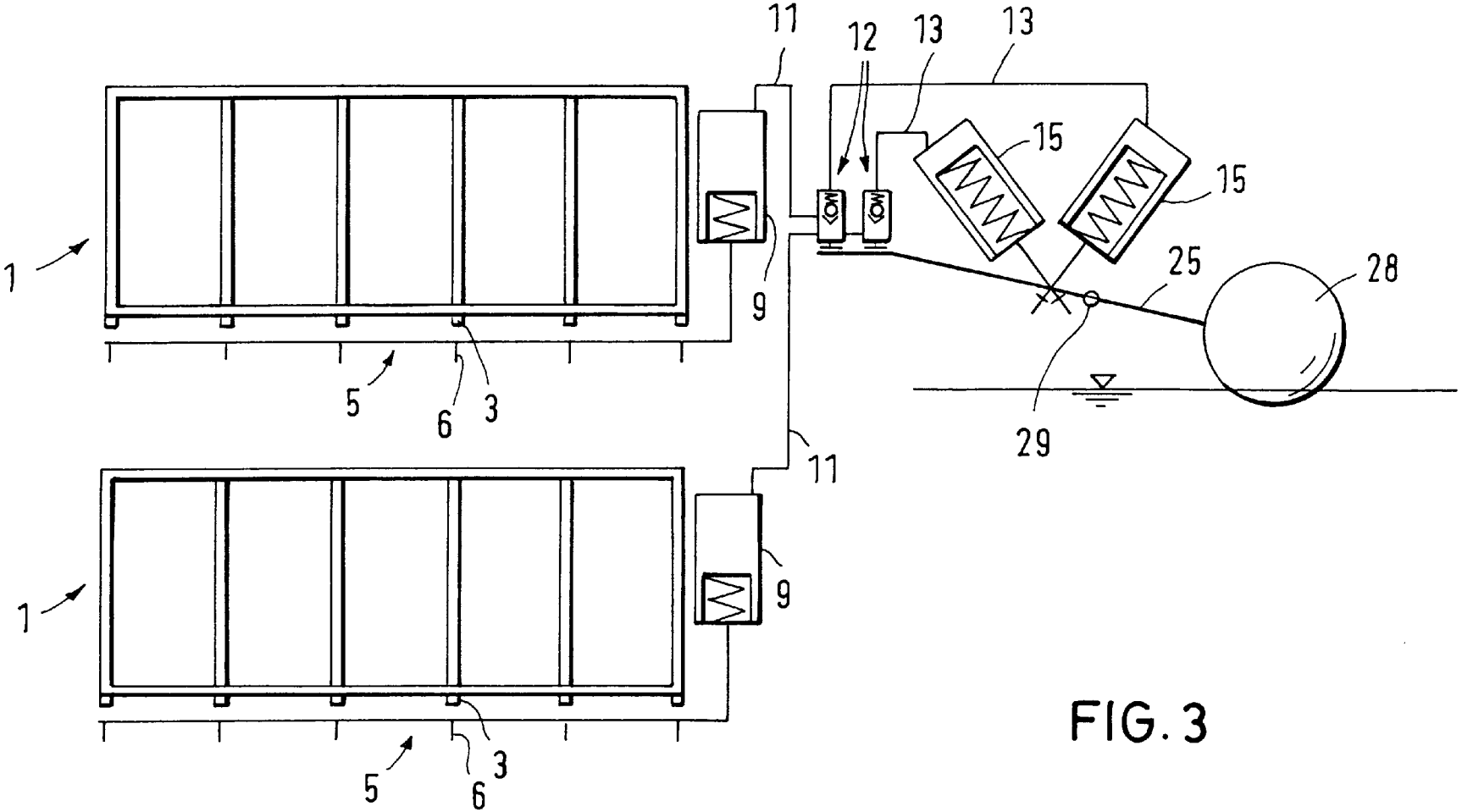
FIG. 3 another implementation form in which the closing mechanisms of two flaps are operated by means of one float rod common to these, FIG. 4 another implementation form for illustration of a battery-like construction in which the closing mechanisms of a multiplicity of cut-off flaps are operated by one float rod, FIG. 4*a* a view of the various valves applicable in the configuration according to FIG. 4, FIG. 5 a implementation form of a device for operating a locking mechanism of a tilt-rinsing device, FIG. 6 another implementation form of a device for operating a locking mechanism of two modified tilt-rinsing fixtures by means of float rods common to these, FIGS. 7A, 7B, 7C, and 7D variations of float, cylinder and valve arrangements with different positions of the float arm pivot points, FIG. 8 another implementation form where an additional float is provided for operating the valves, FIG. 9 another implementation form where the rinsing fixture is designed as a raisable and lowerable container that in its lowered position can be held fixed to the floor of the storage space by means of the locking fixture and FIG. 10 a section through a check valve modified according to the invention.

The implementation form described below is based on the same manner of operation as the implementation forms described above:

FIG. 3 shows the control of two cut-off flaps 1 by means of a common float rod 25 with float 28. Associated with each cutoff flap 1 are a cylinder 9, pipes 11 and 13, a check valve 12 as well as a cylinder 15. The single float rod 25 is penetrated by both rods 24 of cylinder 15, the rods 24 being provided with drive plates 26. Further, the float rod 25 works in conjunction with the plungers 20 of both check valves 12.

Figures 4, 4A:
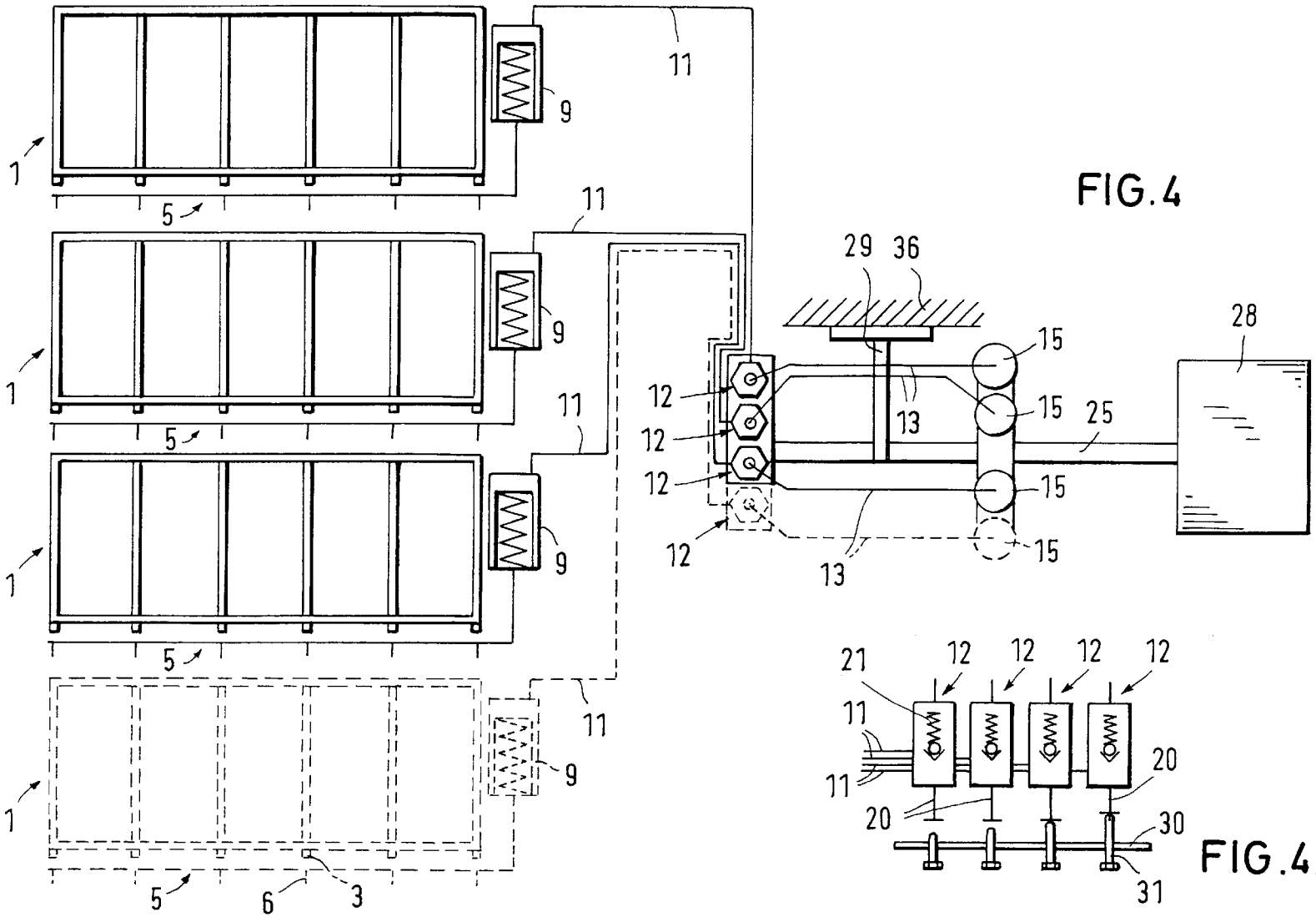

FIG. 4 shows a configuration of the invention by which a multiplicity of cutoff flaps 1 can be operated. Here also, associated with each cut-off flap 1 are a cylinder 9 and 15, a check valve 12, and pipes 11 and 13. This implementation form also shows the pressure springs 22 and 23. A wall is indicated by the reference numeral 36 on which the float rod 25 with float 28 is attached so that it can pivot. FIG. 4*a* is to be seen in the context of the representation of FIG. 4 and illustrates in a cross-beam 30 of the float rod 25 screws 31 screwed in to different depths, which can be brought into active connection with the plungers 20 of the associated check valves 12, whereby the screws 31, due to the different depths to which they are screwed in, release the check valves 12 at different points in time and thus the cut-off flaps 1 are opened and their rinses are released at different points in time.

Figure 5:
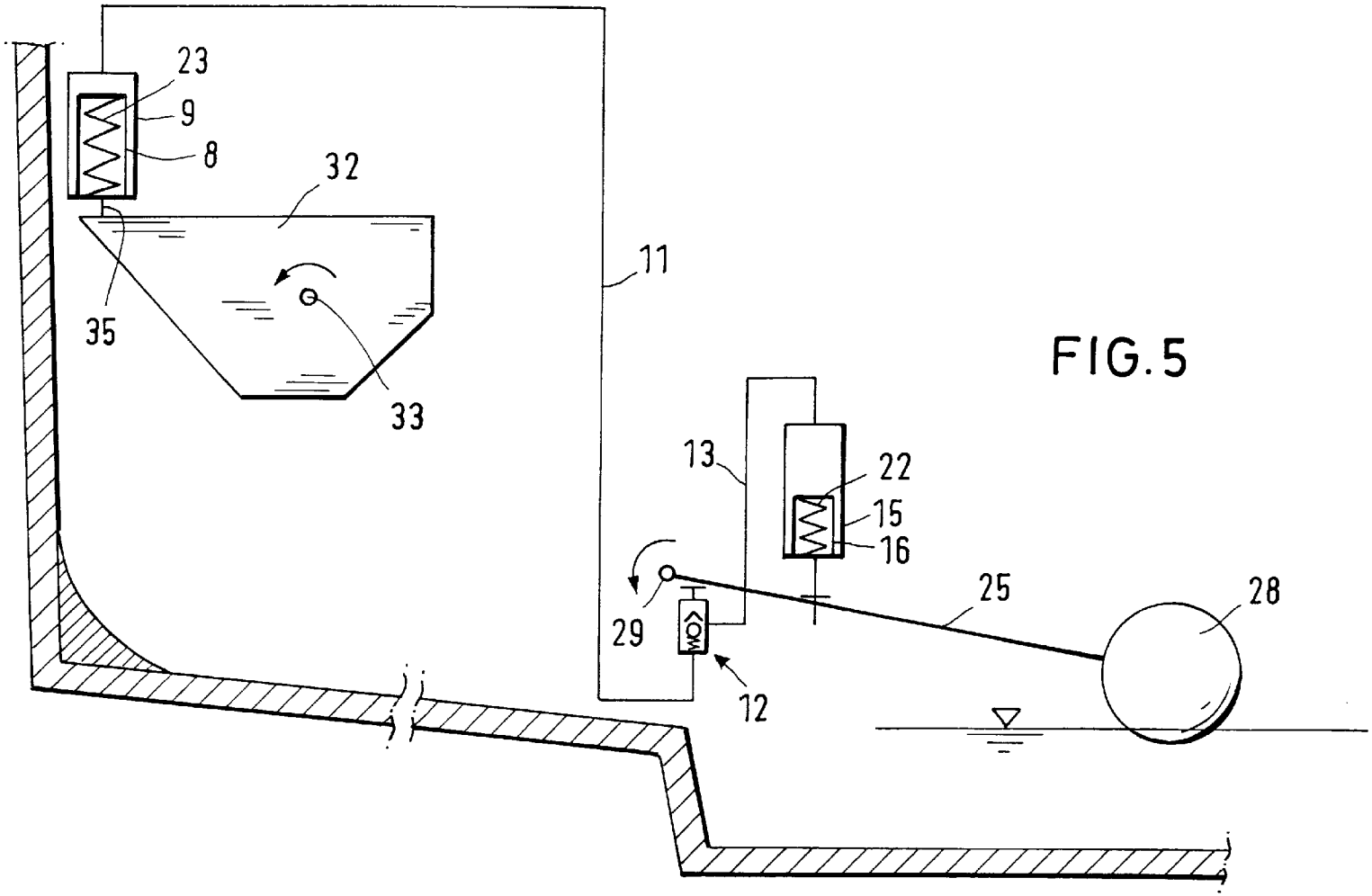

FIG. 5 shows a tilt-rinsing fixture whereby the actual rinsing container 32 can be pivoted on an axis 33 that is not arranged at the center of gravity of the rinsing container 32 so that after emptying the rinsing container 32 automatically rights itself into the position shown in FIG. 5. The rinsing container 32 is arranged above the floor of the storage space for liquid and is, for example, filled with stored liquid. In order to ensure that it only empties if the area of the liquid storage space or channel that is to be rinsed has emptied, the locking mechanism 35 is provided for; it is constructed in the simplest manner through the slideable piston rod 27 of cylinder 9 and in an end position prevents the rinsing chamber 32 from tipping. In this respect reference can be made to the implementation in FIGS. 1*a* through 1*c* and 2*a* through 2*c*, with the basic difference that with the implementation form according to FIG. 5 a pressure spring 23 is arranged in the cylinder 9 associated with rinsing container 32, which spring is relatively strong, while the spring 22 arranged in the other cylinder 15 is relatively weak, and further, that by way of a single-armed float rod 25 with the raising of the float 28 the space for hydraulic fluid in cylinder 15 is decreased through the compression of bellows 16 in cylinder 15 and correspondingly the space in cylinder 9 is increased by expansion of the bellows 8, and further that the check valve 12 is passed through in the opposite direction so that it closes off the flow from pipes 11 and 13 when the plunger 20 is not operated.

Figure 6:
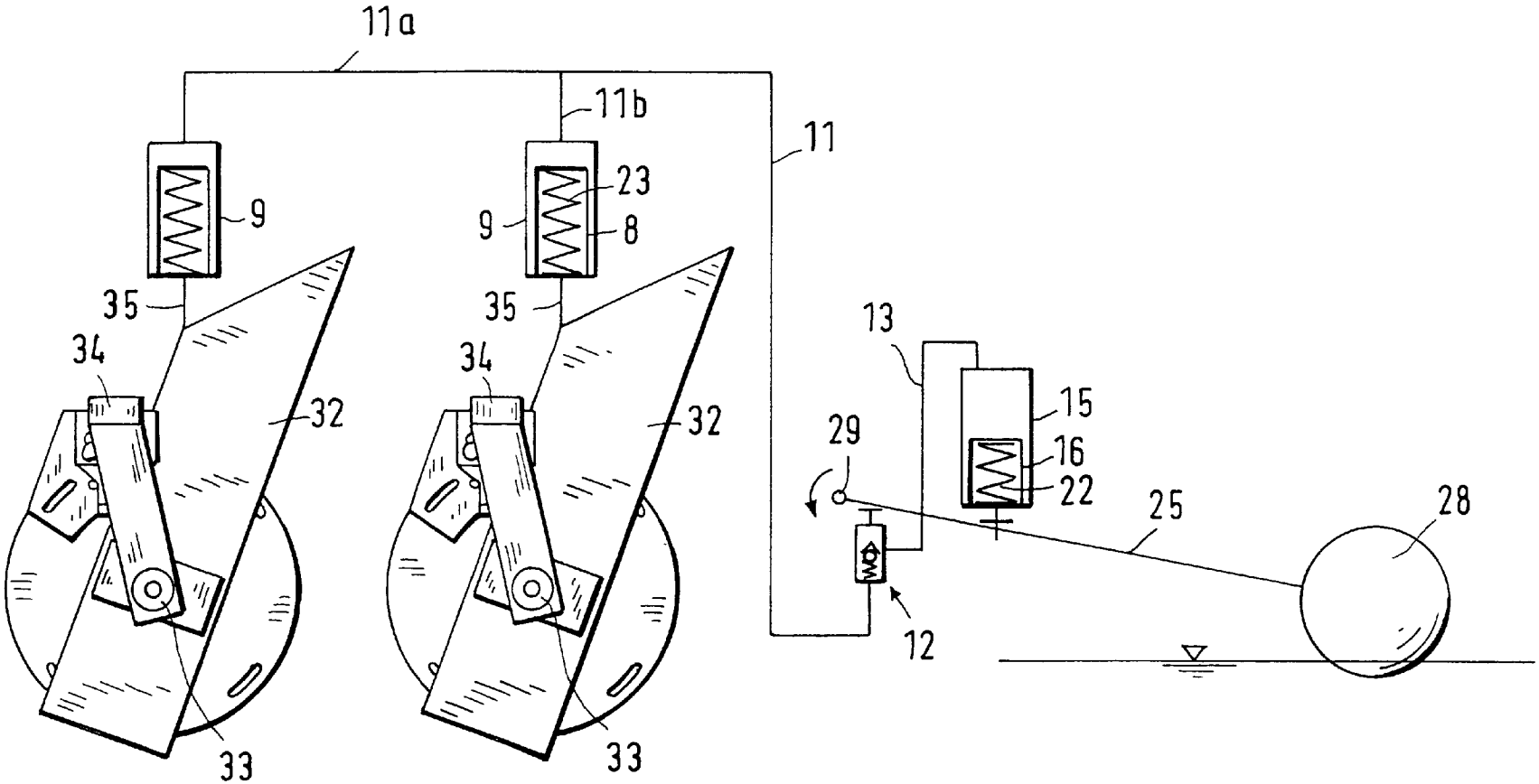
Figure 7A:
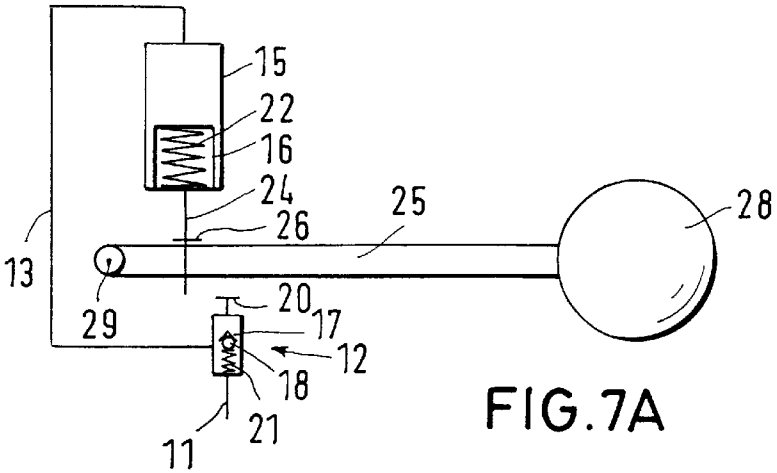
Figure 7B:
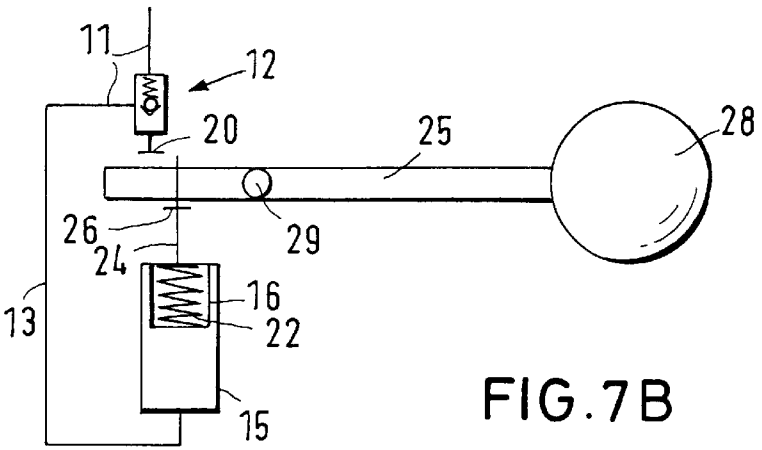
Figure 7C:
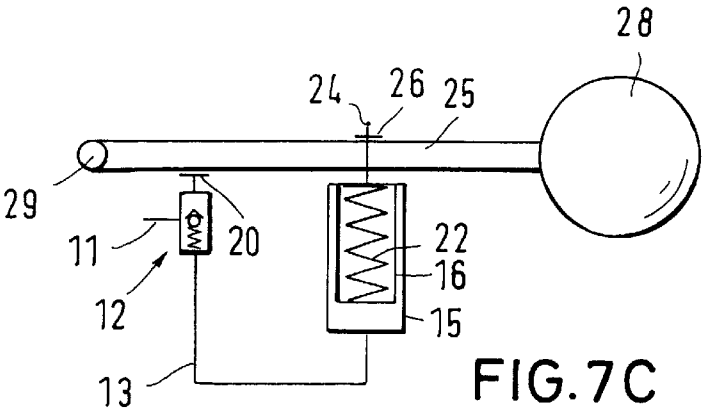
Figure 7D:
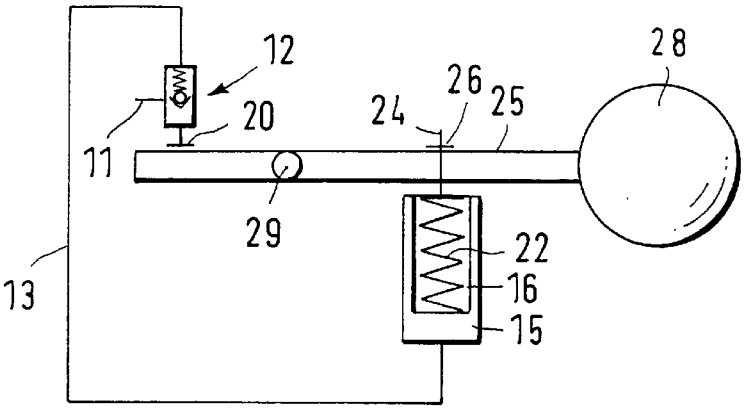

FIG. 6 shows a variant based on the implementation form according to FIG. 5 in which the pipe 11 separates into two sections 11*a* and 11*b* that lead to cylinders 9 and that work in conjunction with two rinsing containers 32. With this implementation form each rinsing container 32 is provided with a counterweight 34 that assures that the rinsing container 32 associated with it, after the emptying, rights itself automatically into the position shown in FIG. 6. With this configuration a large-volume cylinder 15 is used that works together with two cylinders 9 that show a smaller volume.

The FIGS. 7A through 7D show variations of float, cylinder, and valve arrangements with different locations of the float-arm pivot point for application with the different types of rinsing fixtures.

Figure 8:
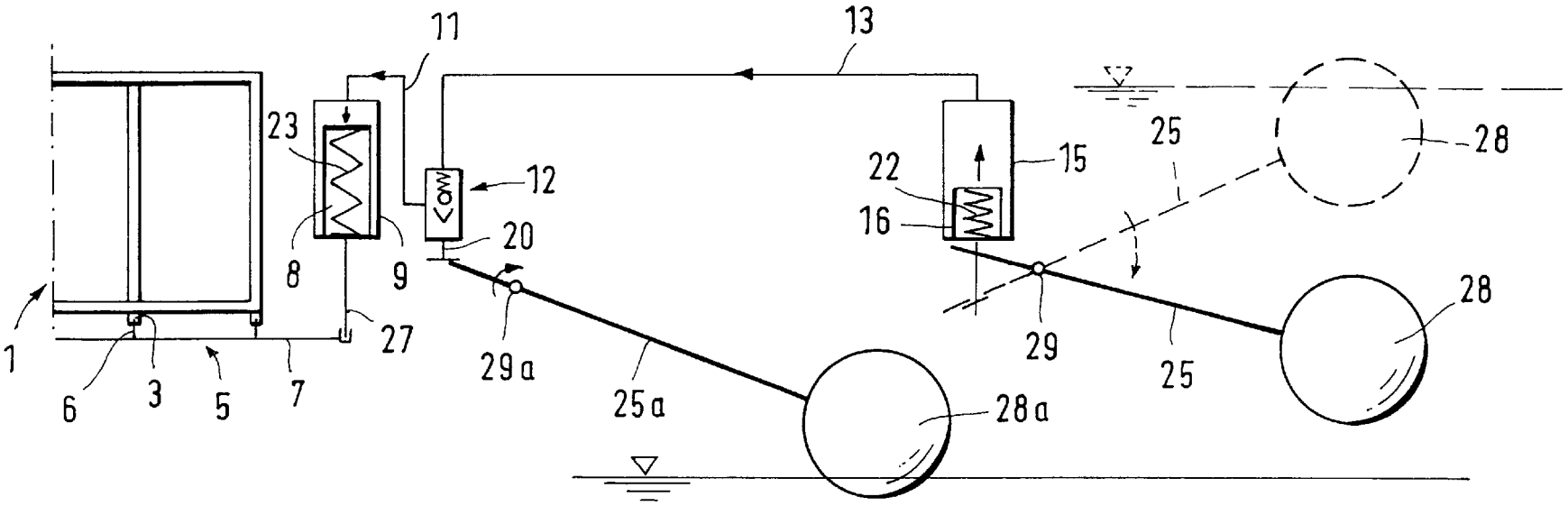

FIG. 8 shows a modified implementation form where provision is made for an additional float 28*a*, which is taken up by a float rod 25*a* that can pivot about an axis 29*a*. This auxiliary float effects the opening of the check valve 12 upon complete or nearly complete emptying of the storage space, since the section of the float rod 25*a* that overhangs the axis 29*a* pushes the plunger 20 of the check valve 12 and transfers this into its opened position. The method of operation of this implementation form is identical with the implementation form according to FIGS. 1*a* through 1*c* and 2*a* through 2*c* with the difference that there the float 28 takes on the function of floats 28 and 28*a* according to the implementation form of FIG 8.

Figure 9:
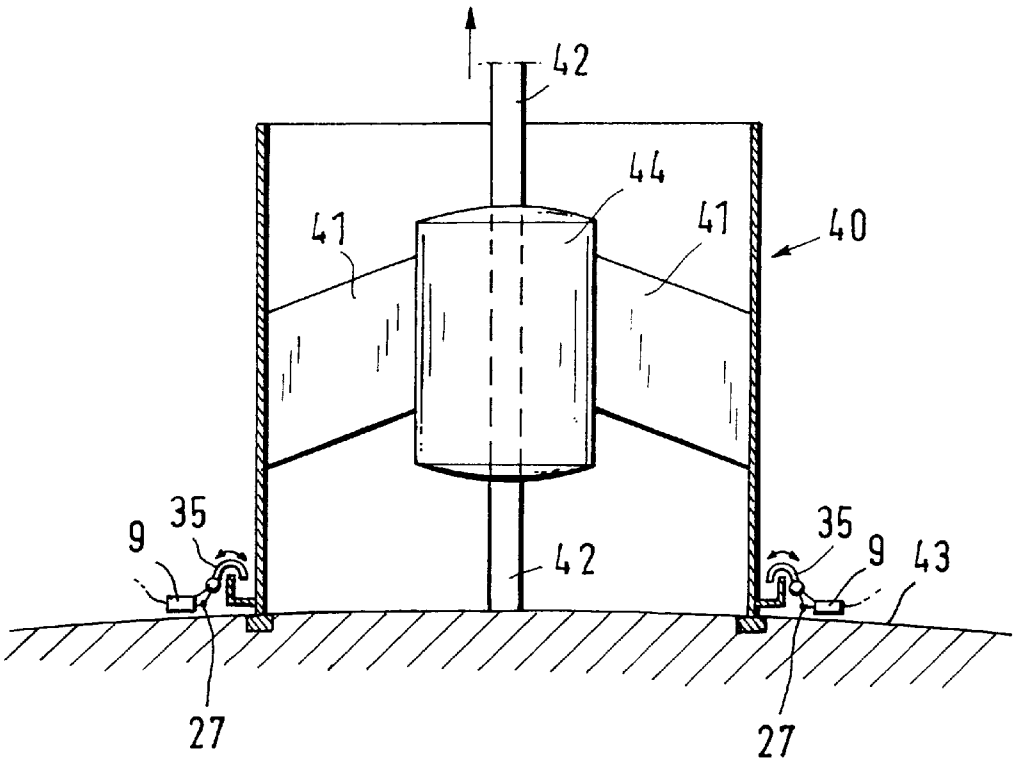

FIG. 9 illustrates a container-type rinsing fixture. A cylindrical container 40 is mounted on a stand 42 and is displaceable through a strut 41 and a mounting bushing connected to this, not illustrated in detail. The stand 42 is arranged to be oriented vertically in a central region of the liquid storage space and is connected to the basin bottom 43. Inside the container 40 is mounted a float 44 that surrounds the mounting bushing; the float 44 provides buoyancy for the container 40. On the basin bottom 43 two hook-formed clamping elements 35 are mounted so they can pivot. If a particular clamping element 35 is to be pivoted by means of the cylinder 9 described in the previous implementation forms, the piston rod 27 of the cylinder 9 grips a lever extension of the clamping element 35. Not shown in FIG. 9 in the sense of the previous implementation forms are the other components working together with the cylinder 9; in this respect reference is made to the previous illustrations. With the emptying of the liquid storage space the clamping elements 35 are disengaged by the float control and the container 40 filled with liquid rises. The closing off of the container rinsing fixture could take place, for example, at the stand 42, preferably in its upper region.

Figure 10:
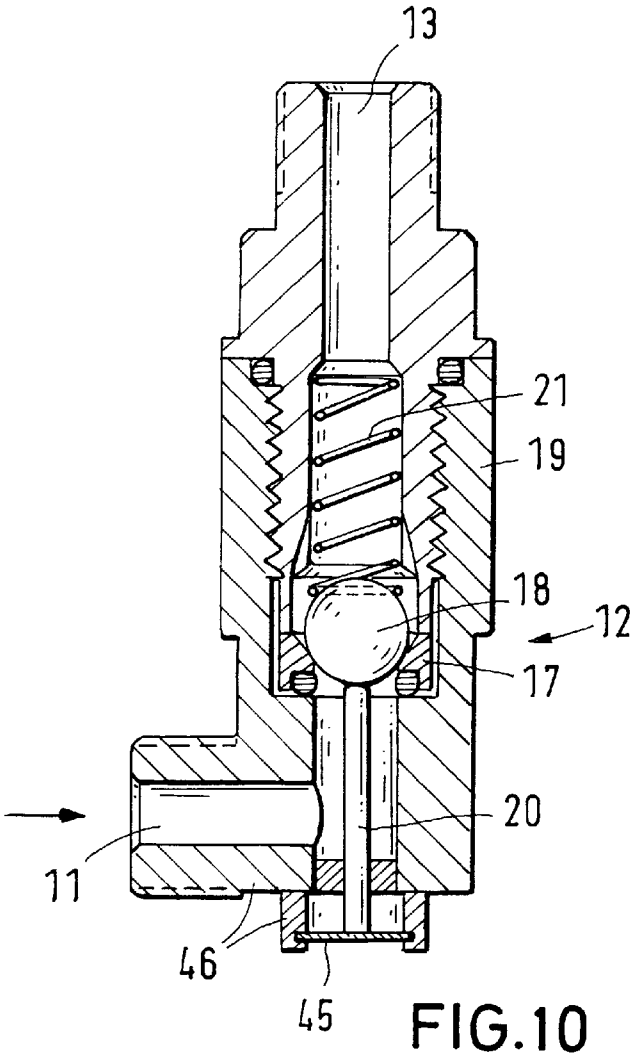

FIG. 10 shows a detailed representation of the valve 12 as described in relation to the previous implementation forms.

This shows a displaceable plunger 20 for lifting from its associated seat 17 the ball 18 that closes off the passage through the valve. At its end that is turned away from ball 18, the plunger 20 is connected with an elastic steel membrane 45 that is held in a sealed fashion in the valve housing 46. By means of float rod 25 or, in the case of the implementation form according to FIG. 8, by means of float rod 25*a*, the steel membrane 45 and thus the plunger 20 are pushed against the force of the coil pressure spring 21 and release the check valve 12 from its closing-off position.

What is claimed is:

1. An arrangement for operating a rinsing fixture, comprising: means in said fixture operated for opening and closing said fixture; a float and first fluid force means having first regulating means controllable through said float; second fluid force means having second regulating means connected to said first regulating means, said first regulating means being connected to said means in said fixture, said float when rising driving said first regulating means for operation of said means in said rinsing fixture against restoring force means; said float upon sinking being uncoupled from said first regulating means; connection means connecting said first fluid force means with said second fluid force means; valve means in said connection means controlled by said float for moving said first regulating means so that said connection means is open during rising of said float, said connection means being closed when said float has been raised and upon sinking, said connection means being open when said float has sunk.

2. An arrangement as defined in claim 1, including a float rod connected to said float for driving said first regulating means.

3. An arrangement as defined in claim 1, wherein said restoring force means is a spring-loaded bellows driving said first regulating means.

4. An arrangement as defined in claim 3, including at least one additional spring-loaded bellows for driving an additional fluid force means, said first-mentioned spring-loaded bellows having an effective direction opposite to that of said additional spring-loaded bellows, said additional spring-loaded bellows being weaker than said first-mentioned spring-loaded bellows.

5. An arrangement as defined in claim 1, wherein said first fluid force means has a cylinder receiving said first regulating means, said first regulating means comprising a spring-loaded bellows.

6. An arrangement as defined in claim 1, wherein said float has a float rod, said valve means being a check valve having a basic closed-off direction, said check valve being unblockable against said basic closed-off direction by said float rod.

7. An arrangement as defined in claim 2, wherein said float rod is a lever.

8. An arrangement as defined in claim 1, wherein said float drives said regulating means with a force for operating said means in said rinsing means.

9. An arrangement as defined in claim 1, wherein said second fluid force means comprises a plurality of fluid force means controlled by said valve means.

10. An arrangement as defined in claim 1, wherein said first fluid force means comprises a plurality of first force means and said second fluid force means comprises a plurality of second fluid force means, said valve means comprising a plurality of separate valves and said float having a common float rod for controlling said plurality of first fluid force means and said plurality of said second fluid force means.

11. An arrangement as defined in claim 10, wherein said valves are opened in sequence.

* * * * *